United States Patent [19]

Tumminaro

[11] 4,171,659

[45] Oct. 23, 1979

[54] ELECTRIFIED GUITAR ACCESSORY

[76] Inventor: Peter M. Tumminaro, 335 S. Prospect, Roselle, Ill. 60172

[21] Appl. No.: 958,268

[22] Filed: Nov. 6, 1978

Related U.S. Application Data

[63] Continuation of Ser. No. 683,207, May 4, 1976, abandoned.

[51] Int. Cl.[2] ..... G10D 5/00

[52] U.S. Cl. ..... 84/1.16; 84/1.15; 84/315; 84/319

[58] Field of Search ..... 84/1.14, 1.15, 1.16, 84/9, 171, 173, 258, 267, 269, 312 P, 315–320, 322, DIG. 21, DIG. 24

[56] References Cited

U.S. PATENT DOCUMENTS

| | | | |
|---|---|---|---|
| 1,690,860 | 11/1928 | Gonzalez | 84/322 |
| 2,033,826 | 3/1936 | Haium | 84/294 |
| 2,500,172 | 3/1950 | Gillenwater | 84/267 |
| 2,945,408 | 7/1960 | Terlinde | 84/1.14 |
| 3,194,104 | 7/1965 | Rhodes | 84/319 |
| 3,290,425 | 12/1966 | Stobaugh | 84/1.16 |
| 3,386,325 | 6/1968 | Smith | 84/315 |
| 3,454,703 | 7/1969 | Rose | 84/1.15 |
| 4,064,781 | 12/1977 | Fals | 84/1.15 |
| 4,075,921 | 2/1978 | Heet | 84/1.15 |

*Primary Examiner*—Gene Z. Rubinson

*Attorney, Agent, or Firm*—Hill, Van Santen, Steadman, Chiara & Simpson

[57] ABSTRACT

An accessory for use on a guitar or similar stringed instruments comprises the combination of a rigid member adapted to be manually held against the strings of the instrument along the finger board, there being a vibration-responsive electrical pickup fixedly secured to the rigid member and adapted to be connected to an electrical audio amplifier.

8 Claims, 4 Drawing Figures

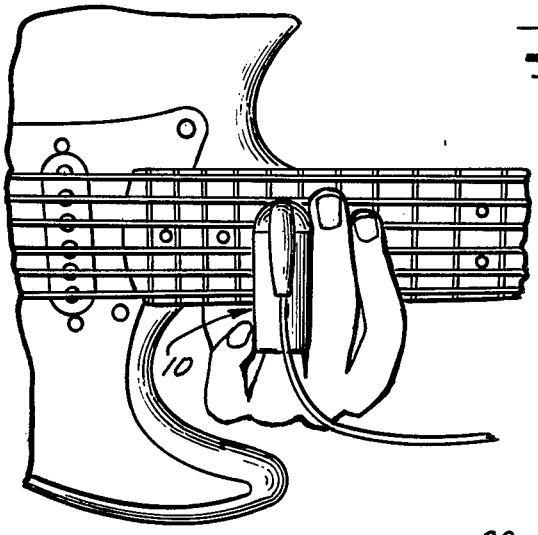
Fig. 1
Fig. 4
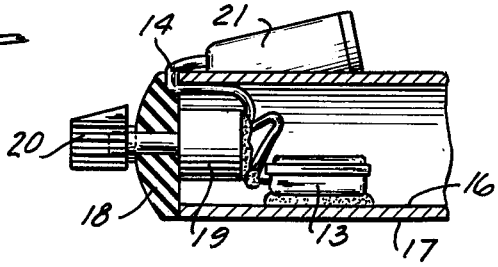
Fig. 2
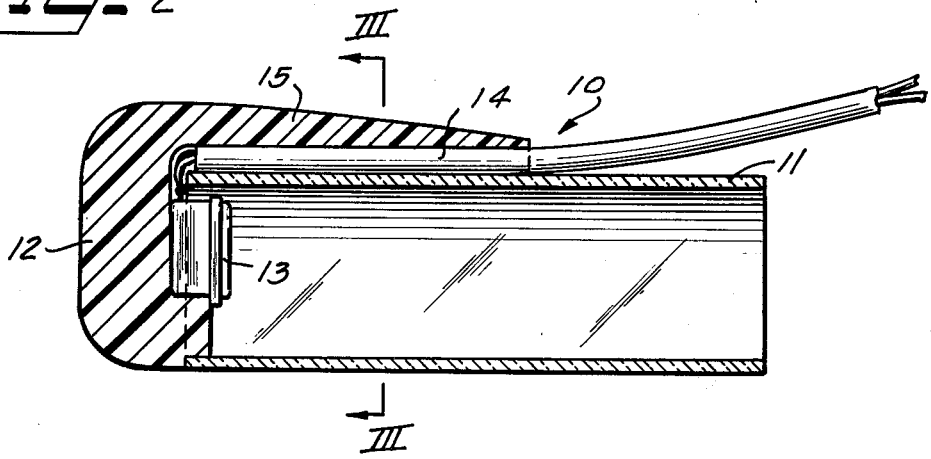
Fig. 3
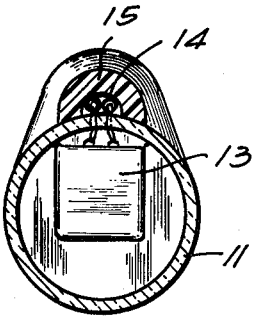

ELECTRIFIED GUITAR ACCESSORY

This is a continuation of application Ser. No. 683,207, filed May 4, 1976, now abandoned.

BACKGROUND OF THE INVENTION

1. Field of the Invention

This invention relates to a hand-held bar for engaging strings of a musical instrument, such as a guitar during the playing thereof.

2. Prior Art

In the playing of a Hawaiian guitar, the instrument is usually arranged so that the strings are horizontal, and the musician "fingers" the instrument by sliding a rigid bar along the strings to designated points to alter the speaking length thereof. This had been a common practice for both acoustic and electric Hawaiian guitars.

It has also been known to make such rigid member tubular so that it slips over one finger of the musician, and to use the same with either acoustic or electric guitars which are otherwise held in a non-horizontal conventional manner. In the entertainment field, this style of playing is now called "slide guitar" because of the glissando or portamento effects that are created. In these examples, all that the rigid member does is define the effective or speaking length of the string lying between the bridge and the bar or slide member.

SUMMARY OF THE INVENTION

According to the present invention, a rigid member is utilized as the slide bar, which preferably is tubular, but which incorporates therewith a dynamic electrical pickup, namely one that is responsive to the mechanical vibrations that are imparted by the strings to the rigid bar. The pickup is provided with appropriate connections that enable the same to be connected to an electric audio amplifier. This device can thus be used as a mode of electrifying an acoustic guitar, or as a means for adding supplemental signals of a different tonal character to that of an electric guitar.

Accordingly, it is an object of the present invention to provide means for providing new sounds for a musical instrument, reproduced through an audio amplifier.

Another object of the present invention is to enable an acoustic guitar to have an output passing through an audio amplifier which is not dependent upon string movement through a magnetic field to induce a signal, and which is not dependent upon the sensing of acoustic sound waves, as would be the case with a microphone.

Yet another object of the present invention is to provide a means for supplementing the tonal flexibility of an electrified guitar.

Many other advantages, features and additional objects of the present invention will become manifest to those versed in the art upon making reference to the detailed description and the accompanying sheet of drawings in which preferred structural embodiments incorporating the principles of the present invention are shown by way of illustrative example.

ON THE DRAWING

FIG. 1 is a fragmentary elevational view showing the playing of an electric guitar with its conventional signals being supplemented by electrical signals produced by a bar provided in accordance with the principles of the present invention;

FIG. 2 is an enlarged cross-sectional view of the bar assembly shown in FIG. 1;

FIG. 3 is a cross-sectional view taken along line III—III of FIG. 2; and

FIG. 4 is a fragmentary elevational view of a modified form of the invention.

AS SHOWN ON THE DRAWING

The principles of the present invention are particularly useful when embodied in a bar for use in playing a stringed musical instrument in the manner of a Hawaiian guitar such as shown in FIG. 1, generally indicated by the numeral 10. The bar comprises a rigid member 11 comprising metal, glass, or a substitute having equivalent rigidity. In this embodiment, the rigid member 11 is tubular, there being closing means 12 at one end thereof which rigidly supports the vibration-responsive electrical pickup 13 which, for example, may be cemented thereto. Appropriate conductor means 14 are connected to the pickup 13 electrically and are guided along the longitudinal extent of the rigid member 11 toward the open end thereof by a strain-relief portion 15 which here is molded as an integral part of the closing means 12. The closing means 12 are cemented into the rigid member 11. In this embodiment, the pickup 13 is carried on an inner end face of the closing means 12, while in the embodiment of FIG. 4, the same pickup 13 is carried on an inner cylindrical surface 16 of a rigid member 17.

In the embodiment of FIG. 4, the electrical conductor means 14 are likewise carried through an end closing means 18 cemented to the rigid member 17.

In the species of FIG. 4, a variable impedance 19 is secured to the closing means 18, the same here comprising a variable resistor having a control knob 20 accessible from the outside of the rigid member 17. The closing means 18 may comprise rubber, and also may comprise other electrically insulated material such as a general purpose thermo-setting phenolic or a thermo plastic acrylic.

In the embodiment of FIG. 4, the electrical conductor terminates in a conventional electrical connector 21 that has terminals connected to the individual conductors.

In use, the device is held and used as shown in FIG. 1. It may be positioned to extend across all of the strings, and yet other playing styles involve having it extend only across some of the higher pitched strings, thus enabling the other strings to be separately fingered. When the bar 10 is moved in the direction of the strings, transversely to its own axis, the pitch will change. If it is wiggled in that direction, a vibrato is produced. If the bar is moved axially, along its own axis, a tremolo effect is produced.

The pickup 13 is of a commercially available magnetic or reluctance or dynamic type which does not require any magnetic field, but which is responsive to the movements that are transmitted thereto. Thus, the pickup 13 as mounted is responsive to the vibrations of the rigid member 11, and not to any ambient sound.

The tonal result obtained by this device is that of a new desirable sound. If used with an electric guitar to get slide effects, it is ideal for a musician who is playing lead, while with an acoustic guitar, it adds new dimension to the sounds produced by the instruments playing rhythm. Thus a given instrument produces not only its conventional sounds that one would expect from that type of instrument, but also the added sounds that are developed by the device 10. If desired, such added sounds could be further modified by having their signals run through a phase shifter, distortion device or other tone modifiers.

FIG. 3 shows the pickup 13 mounted on the closing means 12 with its principal plane transverse to the longitudinal axis of the rigid member 11, while FIG. 4 shows the pickup 13 mounted with its principal plane parallel to such axis. Thus, if desired, the pickup 13 may be held in the closing means 12 with its principal plane parallel to such axis, as shown in FIG. 4.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A bar for sliding use on strings in playing a stringed instrument in the manner of a Hawaiian guitar, comprising in combination:

(a) a rigid tubular member which is generally finger-sized and adapted to be manually held against one or more strings of the instrument during the playing thereof;

(b) a string-vibration-responsive electrical pickup fixedly secured to said rigid member and adapted to be connected to an electrical audio amplifier;

(c) separate means closing one end of said tubular member; and (d) electrical conductor means passing through said closing means in circuit with said pickup.

2. A bar according to claim 1 in which said closing means comprises electrically insulative material.

3. A bar according to claim 1 in which said conductor means extends in part longitudinally along the outside of said tubular member toward the open end of said member.

4. A bar for sliding use on strings in playing a stringed instrument in the manner of a Hawaiian guitar, comprising in combination:

(a) a rigid tubular member which is generally finger-sized and adapted to be manually held against one or more strings of the instrument during the playing thereof;

(b) a string-vibration-responsive electrical pickup fixedly secured to said rigid member and adapted to be connected to an electrical audio amplifier;

(c) separate means closing one end of said tubular member; and (d) variable impedance means carried on said closing means and connected in electrical circuit with said pickup.

5. A bar for sliding use on strings in playing a stringed instrument in the manner of a Hawaiian guitar, comprising in combination:

(a) a generally finger-sized rigid tubular member having an inner cylindrical surface receptive of a finger and adapted to be manually held against one or more strings of the instrument during the playing thereof for determining their effective speaking length, said tubular member having a closed end;

(b) an electrical pickup disposed within and fixedly secured to said rigid member and being of a type responsive to the vibrations of said rigid member, and adapted to be connected to the input of an electrical audio amplifier.

6. A bar according to claim 5, said pickup being carried on said closed end.

7. A bar according to claim 6, said pickup being carried on said inner cylindrical surface.

8. A bar according to claim 5 which includes an electrical connector on said rigid member having terminals in circuit with said pickup.

* * * * *